US010076191B2

(12) United States Patent
Chen

(10) Patent No.: US 10,076,191 B2
(45) Date of Patent: Sep. 18, 2018

(54) CHAIR BACK STRUCTURE

(71) Applicant: Hsin-Hua Chen, Kaohsiung (TW)

(72) Inventor: Hsin-Hua Chen, Kaohsiung (TW)

( * ) Notice: Subject to any disclaimer, the term of this patent is extended or adjusted under 35 U.S.C. 154(b) by 0 days.

(21) Appl. No.: 15/465,601

(22) Filed: Mar. 22, 2017

(65) Prior Publication Data

US 2018/0235371 A1 Aug. 23, 2018

(30) Foreign Application Priority Data

Feb. 22, 2017 (TW) ..... 106202571 U

(51) Int. Cl.
*A47C 7/46* (2006.01)
*A47C 7/14* (2006.01)

(52) U.S. Cl.
CPC . *A47C 7/46* (2013.01); *A47C 7/14* (2013.01)

(58) Field of Classification Search
CPC .... A47C 7/46; A47C 7/14; A47C 7/38; A47C 7/402; A47C 7/405; A47C 7/462; A47C 1/023
See application file for complete search history.

(56) References Cited

U.S. PATENT DOCUMENTS 5,100,201 A * 3/1992 Becker, III ..... A47C 31/126 297/296
5,344,211 A * 9/1994 Adat ..... A47C 7/42 297/230.14
5,704,688 A * 1/1998 Schrewe ..... A47C 7/46 297/285
6,616,236 B1 * 9/2003 Su ..... A47C 7/38 248/118
6,843,530 B1 * 1/2005 Wu ..... A47C 7/38 297/284.3
6,938,956 B1 * 9/2005 Piretti ..... A47C 7/38 297/230.14
7,303,232 B1 * 12/2007 Chen ..... A47C 7/38 297/284.7
7,475,943 B1 * 1/2009 Huang ..... A47C 7/405 297/284.4
7,874,619 B2 * 1/2011 Harley ..... A47C 7/46 297/284.4
8,408,647 B2 * 4/2013 Wu ..... A47C 7/402 297/285
8,602,496 B2 * 12/2013 Lu ..... A47C 7/448 297/285
2005/0017560 A1 * 1/2005 Bastas ..... A47C 7/402 297/353

(Continued)

*Primary Examiner* — James M Ference
(74) *Attorney, Agent, or Firm* — Leong C. Lei

(57) ABSTRACT

A chair back structure is disclosed and includes a chair back that includes a frame, an upper support pad coupled to an upper portion of the frame, and a lower support pad arranged at a lower end of the upper support pad, and an elastic connection piece connecting the upper support pad and the lower support pad to each other. The upper support pad includes a lower support pad coupling seat. The lower support pad includes an upper support pad coupling seat. The elastic connection piece has an upper end mounted to the lower support pad coupling seat of the upper support pad and a lower end mounted to the upper support pad coupling seat of the lower support pad, so that the lower support pad is provided with elasticity and movability by means of the elastic connection piece.

4 Claims, 5 Drawing Sheets

(56) References Cited

U.S. PATENT DOCUMENTS

2005/0093356 A1* 5/2005 Liu ..... A47C 7/64 297/353
2005/0189810 A1* 9/2005 Wu ..... A47C 7/40 297/452.29
2005/0275263 A1* 12/2005 Norman ..... A47C 7/46 297/284.4
2005/0275264 A1* 12/2005 Norman ..... A47C 7/46 297/284.4
2009/0115235 A1* 5/2009 Bock ..... A47C 7/462 297/284.7
2009/0146476 A1* 6/2009 Kan ..... A47C 1/03255 297/284.4
2009/0302663 A1* 12/2009 Allison ..... A47C 7/282 297/452.18
2010/0237679 A1* 9/2010 Tsukiji ..... A47C 7/282 297/452.18
2011/0215623 A1* 9/2011 Tsai ..... A47C 7/402 297/301.1
2011/0233979 A1* 9/2011 An ..... A47C 7/46 297/284.4
2011/0298260 A1* 12/2011 Hsuan-Chin ..... A47C 7/402 297/284.7
2012/0193959 A1* 8/2012 Chen ..... A47C 7/38 297/301.1
2012/0193962 A1* 8/2012 Chen ..... A47C 7/402 297/353
2013/0001993 A1* 1/2013 Kurata ..... A47C 7/462 297/284.4
2013/0043707 A1* 2/2013 Yoon ..... A47C 1/146 297/284.4
2013/0082499 A1* 4/2013 Schmitz ..... A47C 1/03255 297/285
2013/0154314 A1* 6/2013 Romero ..... A47C 1/023 297/68
2014/0125104 A1* 5/2014 Hasegawa ..... A47C 1/023 297/303.4

* cited by examiner

CHAIR BACK STRUCTURE

(a) TECHNICAL FIELD OF THE INVENTION

The present invention relates generally to a chair back structure, and more particularly to a chair back structure that helps improve comfortableness of use of the chair back structure that comprises upper and lower support pads.

(b) DESCRIPTION OF THE PRIOR ART

To provide stable support to the lower back of a sitter, a chair having upper and lower chair backs has been proposed by chair manufacturers.

As shown in FIG. 1, a conventional chair back 1 that comprises upper and lower backs has a structure that includes a frame 11, an upper support pad 12 coupled to the frame 11, and a lower support pad 13 located below the upper support pad 12 and coupled to the upper support pad 12 and the frame 11. The lower support pad 13 is coupled to the upper support pad 12 by a rigid connection piece 131 that is directly extended from the upper support pad 12 so that the lower support pad 13 is made stably located under the upper support pad 12. The lower support pad 13 is positioned under the upper chair back 12 with such a coupling structure so that the lower support pad 13 provides an effect of supporting of the lower back (the part of the back that is closed to the waist and slightly above the waist) of a sitter to thereby improve the comfortableness of the sitter.

Although the above structure allows a conventional chair back 1 to provide supporting to the lower back of a sitter sitting on a chair, the positioning of an upper portion of the lower support pad 13 of the conventional chair back 1 is achieved with the connection thereof with the upper support pad 12 by means of a rigid connection piece 131 directly extended from the upper support pad 12. This constraints the movability of the lower support pad 13 and leads to generally no flexibility of support (for there is generally no way to move or displace). In addition, mounting or coupling the lower support pad 13 is generally a complicated process. Thus, further improvement is needed.

Thus, it is a challenge of the chair manufacturers to provide a chair back structure that provides movability of the lower support pad and eases a connection operation.

SUMMARY OF THE INVENTION

The primary objective of the present invention is to provide a chair back structure that overcomes the deficiency and drawback of lacking support elasticity and movability of a lower support pad of a conventional chair back that involves upper and lower support pads.

For such a purpose, the primary technical solution adopted in the present invention as defined in claim 1 is to provide a chair back structure, wherein a chair back comprises, at least, a frame, an upper support pad coupled to an upper portion of the frame, and a lower support pad arranged at a lower end of the upper support pad, and an elastic connection piece connecting the upper support pad and the lower support pad to each other, the upper support pad comprising a lower support pad coupling seat, the lower support pad comprising an upper support pad coupling seat, the elastic connection piece having an upper end mounted to the lower support pad coupling seat of the upper support pad, the elastic connection piece having a lower end mounted to the upper support pad coupling seat of the lower support pad, so that the lower support pad is provided with elasticity and movability by means of the elastic connection piece.

The efficacy that the primary technical solution of the present invention as defined in claim 1 may achieve is that an elastic connection pieces is provided to couple and connect an upper support pad and a lower support pad to each other so that the connection of the lower support pad is made simple and also, the elastic connection piece exhibits elasticity or flexibility to help improve the movability of supporting of the lower support pad thereby improving overall comfortableness of the chair back.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3A is an enlarged view of a circled portion of FIG. 3.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
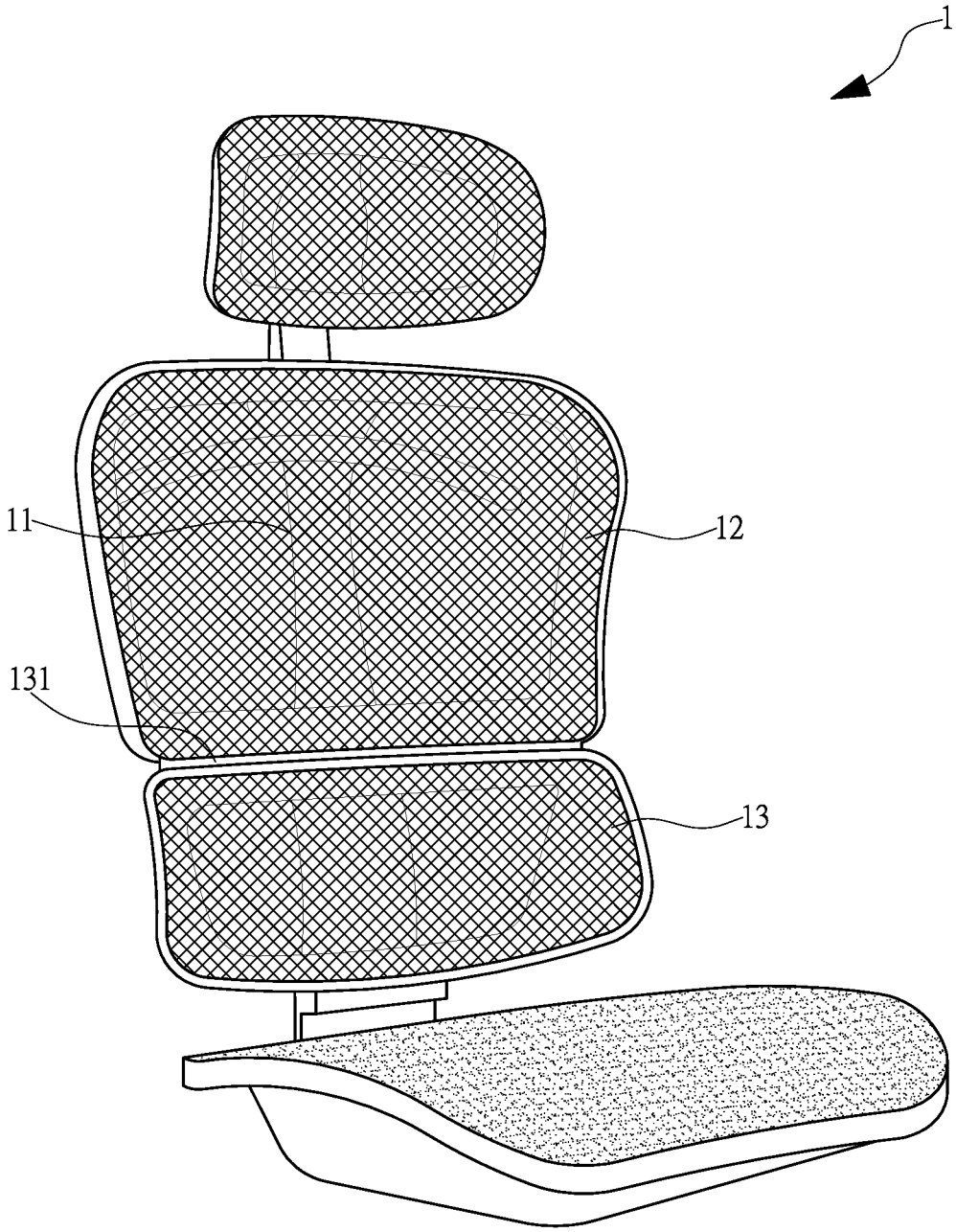
PRIOR ART FIG.1
FIG. 1 is a perspective view showing a conventional chair back having upper and lower support pads.
Figure 2:
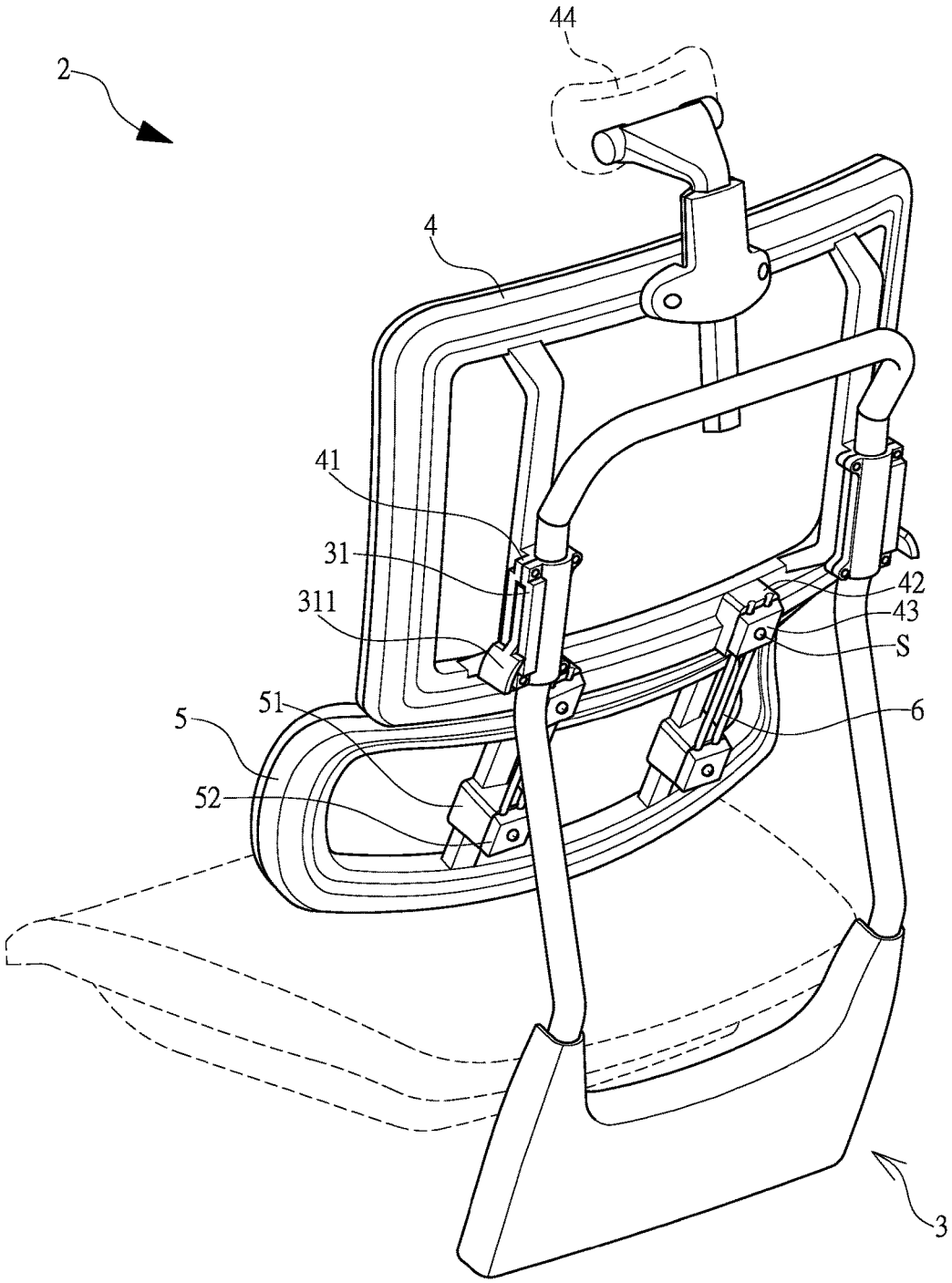
FIG. 2 is a perspective view showing a chair back according to the present invention.

First, reference is made to the illustration of FIG. 2. The present invention provides a chair back structure, in which a chair back 2 comprises a frame 3, an upper support pad 4 arranged at and mounted to an upper portion of the frame 3, a lower support pad 5 coupled to a lower end of the upper support pad 4, and elastic connection pieces 6 that connect the upper support pad 4 and the lower support pad 5 to each other.

Figure 3:
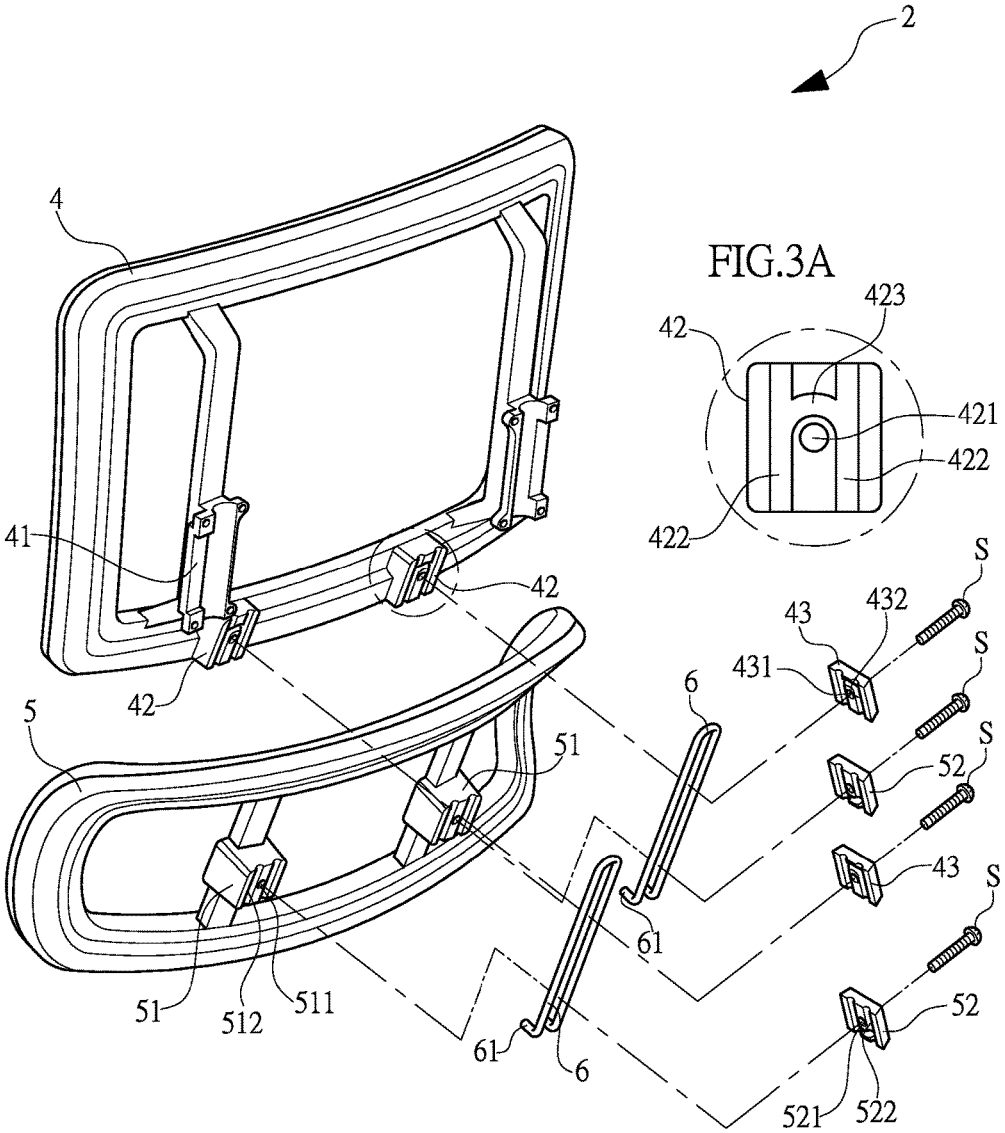
FIG. 3 is an exploded view showing upper and lower support pads of the chair back according to the present invention.

As shown in FIGS. 2 and 3, the frame 3 is generally in the form of roughly a rectangular configuration. The upper portion of the frame 3 comprises upper support pad coupling sections 31 mounted thereto. The upper support pad coupling sections 31 are provided for coupling with the upper support pad 4. The upper support pad coupling sections 31 each comprise an adjustment handle 311, and the adjustment handle 311 is operable to release or tighten (namely fixing in position) the upper support pad coupling section 31 in order to allow the upper support pad 4 to move along the frame 3 upward/downward for position adjustment. More specifically speaking, the upper support pads 4 are movable upward/downward for adjustment of vertical positions thereof by controlling and operating the adjustment handles 311.

As shown in FIGS. 2 and 3, the upper support pad 4 is provided, on an upper portion thereof, with frame mounting sections 41, which are generally arranged on two opposite side portions thereof and corresponding to the upper support pad coupling sections 31 of the frame 3. The frame mounting sections 41 are provided to receive the upper support pad coupling sections 31 of the frame 3 to mount thereto so that the upper support pad 4 is securely mounted to the upper support pad coupling sections 31 of the frame 3. The upper support pad 4 is provided, on a lower portion thereof, with a pair of lower support pad coupling seats 42, generally at a left side portion and a right side portion thereof. The lower support pad coupling seats 42 are each provided, at a location around a middle thereof, with a mounting hole 421, recessed guide grooves 422 arranged at two opposite sides of the mounting hole 421, a connection groove 423 arranged above the mounting hole 421 and connecting the two recessed guide grooves 422, wherein the connection groove 423 is generally a U-shaped groove. The lower support pad coupling seats 42 are each provided with and covered with a lower support pad coupling seat cover 43 that is set on an outside surface thereof. The lower support pad coupling seat cover 43 is provided with a through hole 431 corresponding to the mounting hole 421 of the lower support pad coupling seat 42; and the lower support pad coupling seat cover 43 is also provided with recessed grooves 432 respectively corresponding to the recessed guide grooves 422 and the connection groove 423 of the lower support pad coupling seat 42. The upper support pad 4 is further provided, on a top thereof, with a head rest 44.

As shown in FIGS. 2 and 3, the lower support pad 5 comprises upper support pad coupling seats 51 mounted thereto to respectively correspond to the lower support pad coupling seats 42 of the upper support pad 4. The upper support pad coupling seats 51 are each provided, at a location around a middle thereof, with a mounting hole 511 and recessed guide grooves 512 arranged at two opposite sides of the mounting hole 511. The upper support pad coupling seats 51 are each provided with and covered with an upper support pad coupling seat cover 52 that is set on an outside surface thereof. The upper support pad coupling seat cover 52 is provided with a through hole 521 corresponding to the mounting hole 511 of the upper support pad coupling seats 51, and the upper support pad coupling seat cover 52 is also provided with recessed grooves 522 respectively corresponding to the recessed guide grooves 512 of the upper support pad coupling seat 51.

As shown in FIGS. 2 and 3, the elastic connection pieces 6 are each a connection member that is made in the form of a U-shape that is formed of a metallic material or a composite material in a curved configuration and exhibiting elasticity or flexibility. The elastic connection pieces 6 each have a lower end that is bent sideways to form a barb- or projection-like hook section 61.

Figure 4A:
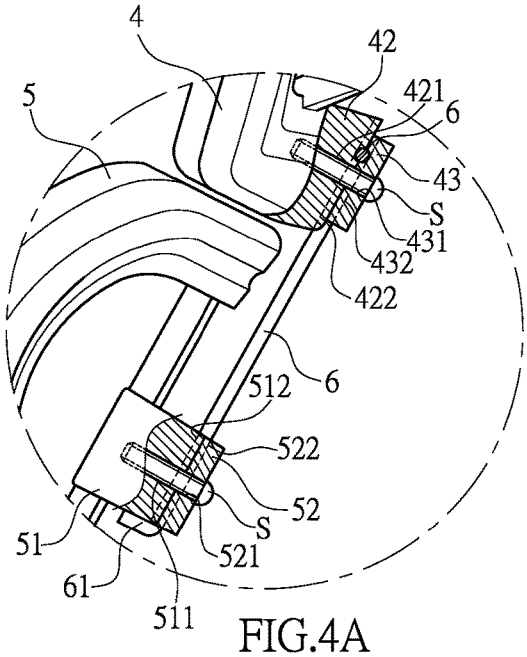
FIG. 4A is an enlarged view of a circled portion of FIG. 4.
Figure 4:
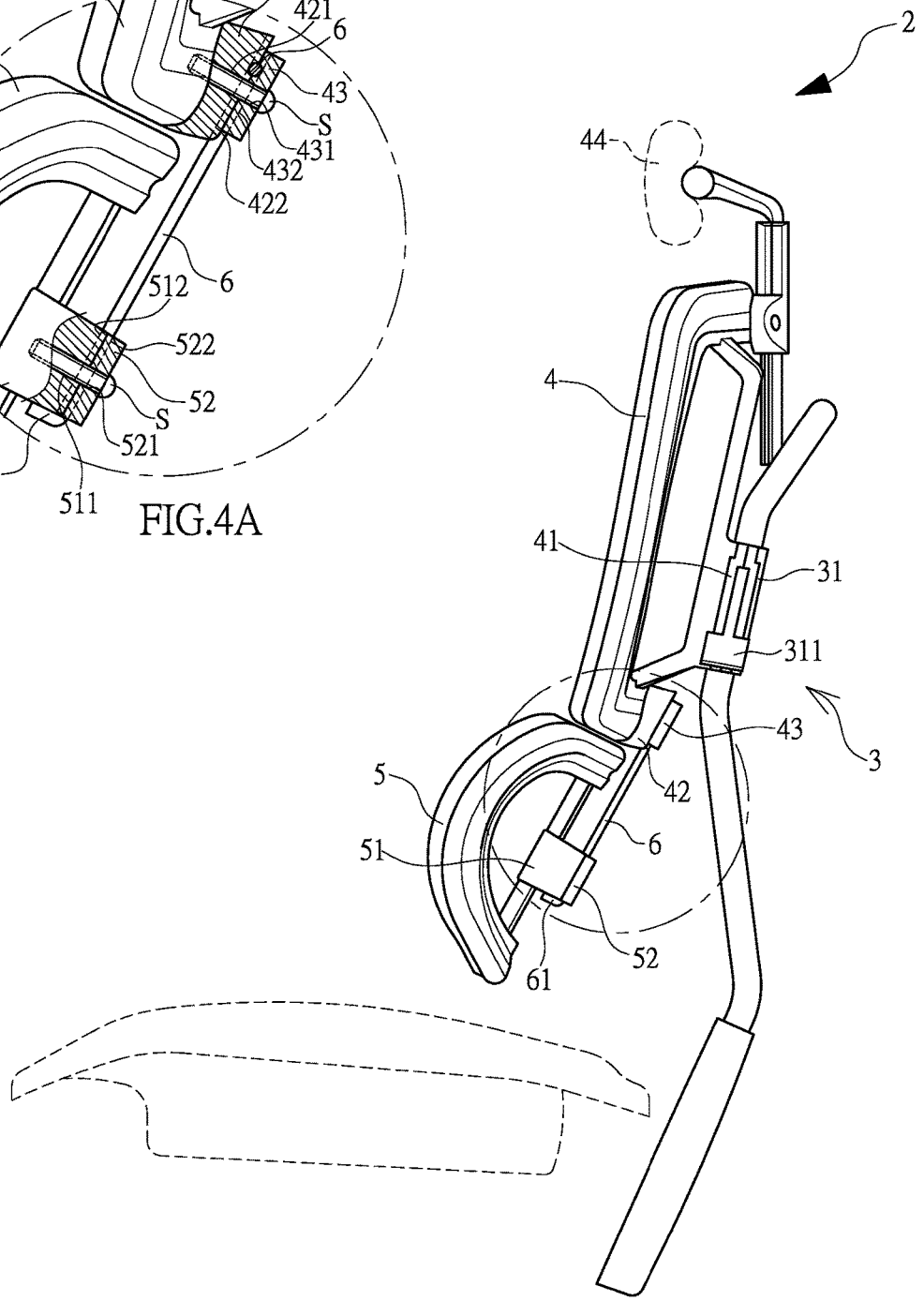
FIG. 4 is a side elevational view of the chair back according to the present invention.

As shown in FIGS. 2, 3, and 4, in an embodiment of the chair back 2 according to the present invention, upper ends of the elastic connection pieces 6 are respectively positioned in the connection grooves 423 of the recessed guide grooves 422 of the lower support pad coupling seats 42 of the upper support pad 4 and then, the covers 43 are respectively set on and covers the outside surfaces of the lower support pad coupling seats 42. Next, threaded fasteners S are set through the through holes 431 of the lower support pad coupling seat covers 43 to screw into the mounting holes 421 of the lower support pad coupling seats 42 so as to fix the upper ends of the elastic connection pieces 6 to the lower support pad coupling seats 42 of the upper support pad 4 to be positioned thereon. The hook sections 61 on the lower ends of the elastic connection pieces 6 are set in hooking and retaining engagement with bottoms of the upper support pad coupling seats 51 of the lower support pad 5 with lower portions of the elastic connection piece 6 being simultaneously and respectively set in the recessed guide grooves 512 of the upper support pad coupling seats 51. Under this condition, the upper support pad coupling seat covers 52 are respectively set on and cover the upper support pad coupling seats 51 and threaded fasteners S are set through the through holes 521 of the upper support pad coupling seat covers 52 to screw into the mounting holes 511 of the upper support pad coupling seats 51 so that the lower ends of the elastic connection pieces 6 are fixed to the upper support pad coupling seats 42 of the lower support pad 5 to be positioned thereon. This completes connection between the upper support pad 4 and the lower support pad 5. Afterwards, the frame mounting sections 41 of the upper support pad 4 are respectively mounted to the upper support pad coupling sections 31 of the frame 3 to complete the assembly of the chair back 2 according to the present invention. It is noted here that the sequence of operations of assembly as described above may be exchanged as necessarily.

Figure 5:
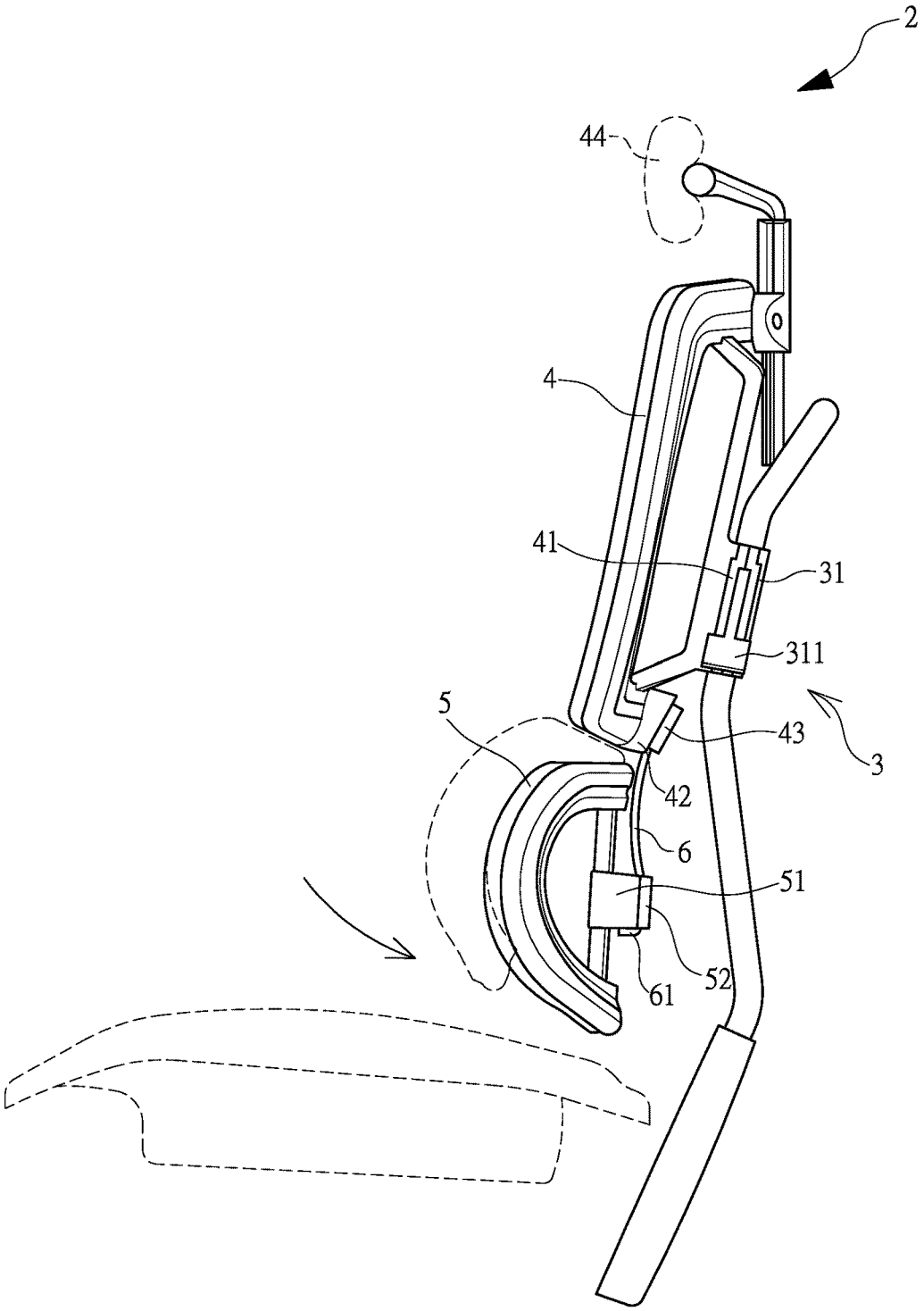
FIG. 5 is a schematic view illustrating use of the lower support pad of the chair back according to the present invention.

As shown in FIG. 5, in use of the chair back 2 according to the present invention, when a portion of a user's body that is close to the waist is positioned against and supported by the lower support pad 5, due to the elasticity or flexibility of the elastic connection pieces 6 that connect the upper support pad 4 and the lower support pad 5 to each other, the lower support pad 5, when receiving a force acting thereon from the waist of the user, would undergo backward retraction (in a direction toward the right side of the drawing sheet) through the elasticity or flexibility of the elastic connection pieces 6 to such an extent that the lower support pad 5 could firmly support the waist of the user in position. As such, the overall comfortableness of the chair back 2 can be improved.

The primary efficacy of the present invention is that elastic connection pieces 6 are provided to couple and connect the upper support pad 4 and the lower support pad 5 to each other so that the connection of the lower support pad 5 is made simple and also, the elastic connection pieces 6 exhibit elasticity or flexibility to help improve the movability of supporting of the lower support pad 5 thereby improving overall comfortableness of the chair back 2.

A secondary efficacy of the present invention is that the upper support pad 4 is provided with lower support pad coupling seats 42, where the lower support pad coupling seats 42 each comprise a mounting hole 421 formed in a middle thereof, recessed guide grooves 422 arranged on two sides of the mounting hole 421, and a connecting groove 423 arranged above the mounting hole 421 and connecting the two recessed guide grooves 422, the connection groove 423 being a groove having a U-shaped configuration; and the lower support pad coupling seats 42 are each provided with and covered with a lower support pad coupling seat cover 43 that is set on an outside surface thereof, the lower support pad coupling seat cover 43 being provided with a through hole 431 corresponding to the mounting hole 421 of the lower support pad coupling seat 42, the lower support pad coupling seat cover 43 being also provided with recessed grooves 432 respectively corresponding to the recessed guide grooves 422 and the connection groove 423 of the lower support pad coupling seat 42, wherein the lower support pad coupling sections 42 are provided for fixing upper portions of the elastic connection pieces 6 so as to provide an effect of secured positioning of the upper portions of the elastic connection pieces 6.

A further efficacy of the present invention is that the lower support pad 5 is provided with upper support pad coupling seats 51, wherein the upper support pad coupling seats 51 are each provided, at a location around a middle thereof, with a mounting hole 511 and recessed guide grooves 512 arranged at two opposite sides of the mounting hole 511, the upper support pad coupling seats 51 being each provided with and covered with an upper support pad coupling seat cover 52 that is set on an outside surface thereof, the upper support pad coupling seat cover 52 being provided with a through hole 521 corresponding to the mounting hole 511 of the upper support pad coupling seats 51, the upper support pad coupling seat cover 52 being also provided with recessed grooves 522 respectively corresponding to the recessed guide grooves 512 of the upper support pad coupling seat 51, wherein the upper support pad coupling sections 51 are provided for fixing lower portions of the elastic connection pieces 6 so as to provide an effect of secured positioning of the lower portions of the elastic connection pieces 6.

A further efficacy of the present invention is that the elastic connection pieces 6 are provided, on lower ends thereof, with hook sections 61, and the hook sections 61 are in hooking and retaining engagement with bottoms of the upper support pad coupling seats 51 so as to provide an improved effect of secured positioning of the lower portions of the elastic connection pieces 6.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A chair back comprising at least, a frame, an upper support pad coupled to an upper portion of the frame, and a lower support pad arranged at a lower end of the upper support pad, and an elastic connection piece connecting the upper support pad and the lower support pad to each other, the upper support pad comprising a lower support pad coupling seat, the lower support pad comprising an upper support pad coupling seat, the elastic connection piece having an upper end mounted to the lower support pad coupling seat of the upper support pad, the elastic connection piece having a lower end mounted to the upper support pad coupling seat of the lower support pad, the lower support pad coupling seat comprising a lower support pad coupling seat cover set on and covering an outside surface thereof, the lower support pad coupling seat cover comprising a through hole formed therein to correspond to the mounting hole of the lower support pad coupling seats, the lower support pad coupling seat cover also comprising recessed grooves formed therein to respectively correspond to the recessed guide grooves and the connection groove of the lower support pad coupling seat, the upper support pad coupling seat comprises, formed therein, a mounting hole formed at a location around a middle thereof and recessed guide grooves formed on two sides of the mounting hole; the upper support pad coupling seat comprises an upper support pad coupling seat cover set on and covering an outside surface thereof, the upper support pad coupling seat cover comprising a through hole formed therein to correspond to the mounting hole of the upper support pad coupling seat, the upper support pad coupling seat cover comprising recessed grooves formed therein to correspond to the recessed guide grooves of the upper support pad coupling seat, whereby the lower support pad is provided with elasticity and movability by means of the elastic connection piece.

2. The chair back structure according to claim 1, wherein the connection groove is a U-shaped groove.

3. The chair back structure according to claim 1, wherein the elastic connection piece has the lower end that forms a hook section, the hook section being in retaining engagement with a bottom of the upper support pad coupling seat.

4. The chair back structure according to claim 1, wherein the frame comprises an upper support pad coupling section formed thereon, the upper support pad coupling section being connectable with the upper support pad, the upper support pad coupling section comprising an adjustment handle, such that the adjustment handle allows the upper support pad coupling section to be released or tightened.

* * * * *